United States Patent [19]

Blevins

[11] Patent Number: 4,857,705

[45] Date of Patent: Aug. 15, 1989

[54] WALL MOUNTED ELECTRIC AIR HEATING DEVICE FOR DRYING OR WARMING A PERSON

[75] Inventor: Gene Blevins, Bremerton, Wash.

[73] Assignee: Galaxy Machine, Inc., Redmond, Wash.

[21] Appl. No.: 97,794

[22] Filed: Sep. 16, 1987

[51] Int. Cl.[4] ..... H05B 1/02; F26B 19/00; F24H 3/04

[52] U.S. Cl. ..... 219/370; 34/243 R; 200/31.9 R; 219/364; 219/366

[58] Field of Search ..... 219/366–373, 219/374–376, 359, 361, 364, 363, 379; 34/96–101, 225, 243 R, 229, 233, 237, 239; 200/81.9 R

[56] References Cited

U.S. PATENT DOCUMENTS

| | | | |
|---|---|---|---|
| 1,091,733 | 3/1914 | Cook | 219/369 |
| 1,217,229 | 2/1917 | Smith | 219/364 |
| 1,517,434 | 12/1924 | Kluever | 219/368 X |
| 2,255,759 | 9/1941 | Carpenter | 219/366 X |
| 2,448,834 | 9/1948 | Rousseau | 34/243 C |
| 2,577,104 | 12/1951 | Butler | 200/81.9 R |
| 2,677,041 | 4/1954 | Oliver et al. . | |
| 2,777,934 | 1/1957 | Falkenthal | 219/364 |
| 2,977,455 | 3/1961 | Murphy | 219/366 |
| 3,007,256 | 11/1961 | Rouy | 34/237 |
| 3,128,161 | 4/1964 | Hudon | 34/233 |
| 3,449,838 | 6/1969 | Chancellor | 219/370 X |
| 3,621,199 | 11/1971 | Goldstein | 219/370 |
| 3,711,958 | 1/1973 | Lepage | 219/370 |
| 3,918,171 | 11/1975 | Hull | 34/243 C |
| 4,454,768 | 6/1984 | Mansel | 200/81.9 R |
| 4,558,526 | 12/1985 | Baus | 34/232 |
| 4,594,797 | 6/1986 | Houck | 34/225 |
| 4,685,222 | 8/1987 | Houck | 34/229 |
| 3,8788,621 | 4/1975 | Duerre | 34/233 X |

FOREIGN PATENT DOCUMENTS

| | | | |
|---|---|---|---|
| 752165 | 7/1933 | France | 219/379 |
| 586949 | 4/1947 | United Kingdom | 219/370 |
| 2140295 | 11/1984 | United Kingdom | 219/373 |
| 2146522 | 4/1985 | United Kingdom | 219/366 |

*Primary Examiner*—Anthony Bartis
*Attorney, Agent, or Firm*—Bruce A. Kaser

[57] ABSTRACT

A wall mounted electric heating device for warming or drying a person standing in front thereof by directing a stream of air on the person includes an elongated vertically upstanding housing adapted to be mounted on a wall and having an upper blower portion housing a blower for generating a downward flow of air over a thermostatically protected electric resistance heating element into an elongated, closed-bottom vent portion having a front wall provided with an elongated, narrow, rectangular front vent opening which has a length corresponding approximately to the height of a person standing in front of the device. The vent portion is defined by flat front, side and rear walls which continuously converge symmetrically with respect to each other to form a downwardly converging air flow conduit having a rectangular cross-section which decreases continuously along the length of the vent portion to its bottom thereof to ensure uniform airflow outwardly along the entire length of the front vent opening. The energization of the heating element is controlled by a timer and an airflow responsive switch allows energization of the heating element only if the blower is operative. A curved air deflector is provided in the upper part of the vent portion to ensure sufficient air flow through the upper portion of the vent opening.

4 Claims, 4 Drawing Sheets

Fig. 1
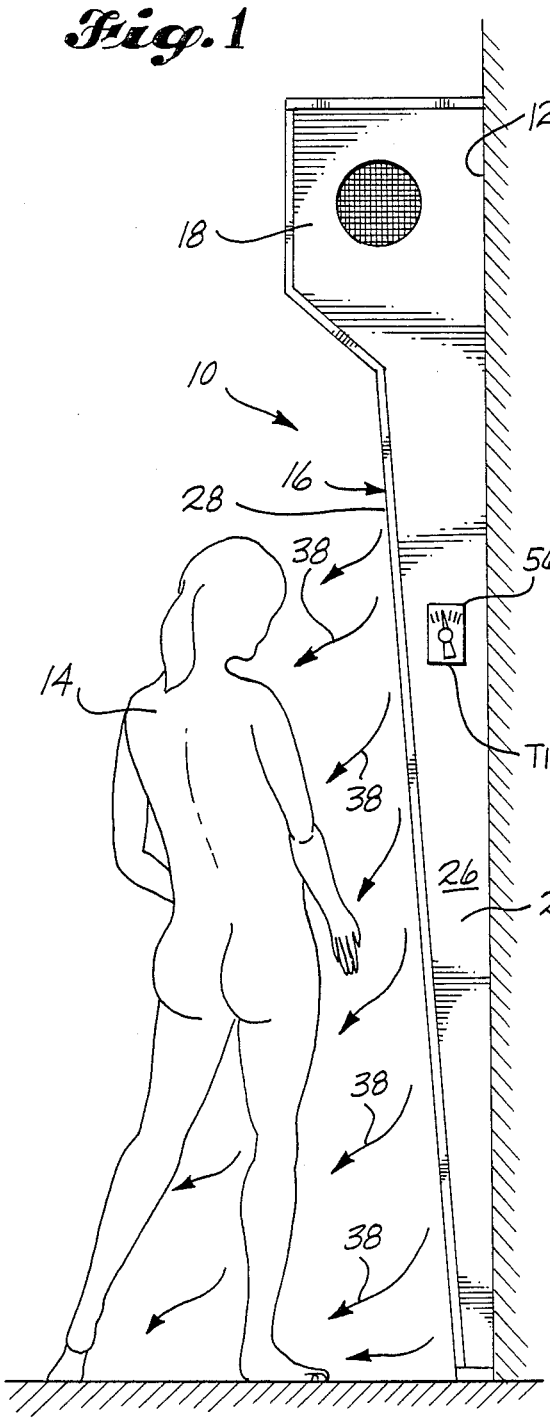
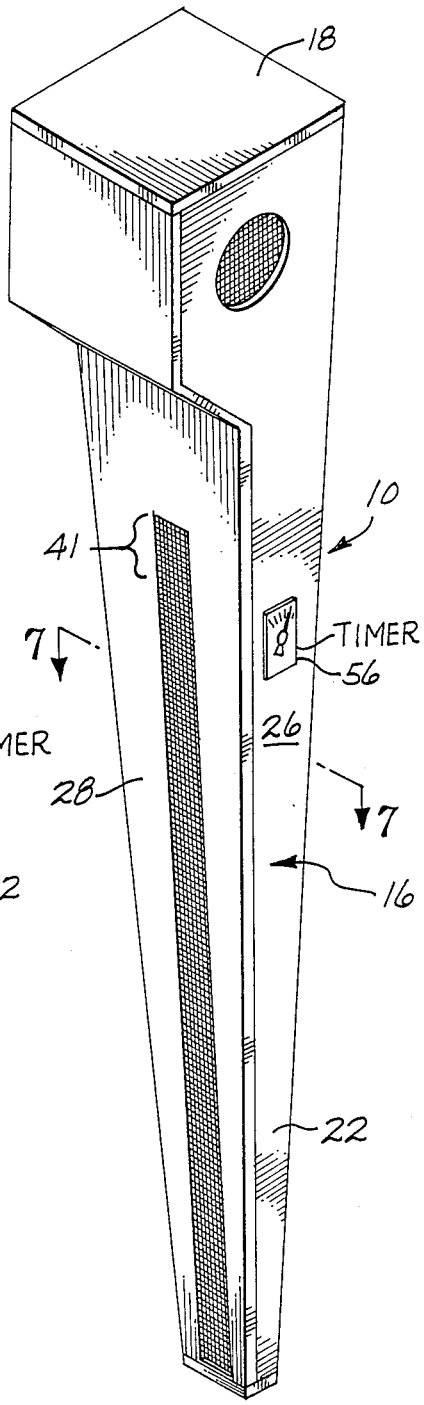
Fig. 2

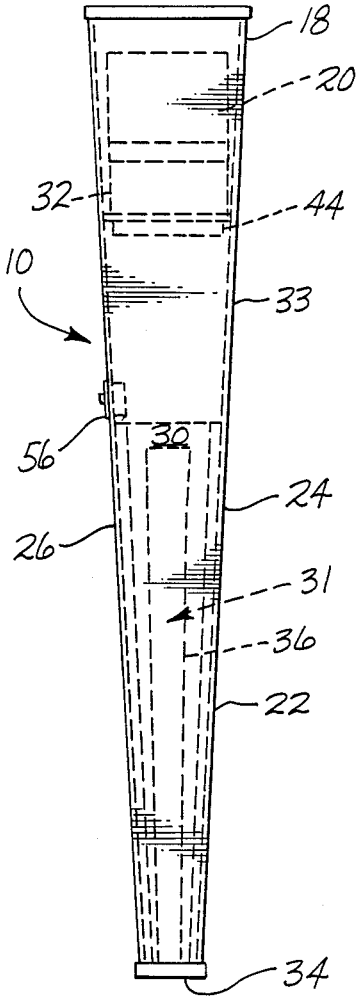
Fig. 6
Fig. 7
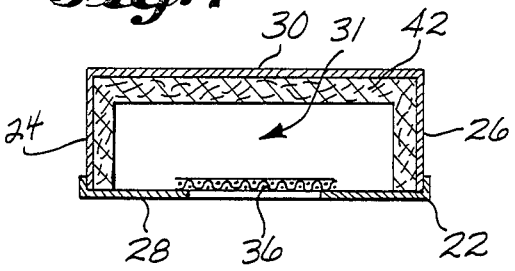

WALL MOUNTED ELECTRIC AIR HEATING DEVICE FOR DRYING OR WARMING A PERSON

TECHNICAL FIELD

This invention relates generally to electric drying devices, and more particularly, to an electric dryer specifically adapted to drying or warming a person's entire body.

BACKGROUND ART

Certain kinds of drying devices for personal use have been well-known in the art for quite some time. For example, most of us are familiar with helmet-style hairdryers which are used in beauty parlors, and hand-held blow dryers used at home for personal grooming. None of these devices are adapted or used to dry more than just a person's head. My invention, on the other hand, is specifically adapted to dry all or most of a person's body. To my knowledge, no one has previously invented a similar device.

U.S. Pats. Nos. 2,677,041 and 3,007,256 are at least two prior art patents which are pertinent to my invention. U.S. Pat. No. 2,677,041, issued to C. J. Oliver on Apr. 27, 1954, teaches the well-known electric hand dryer which is currently in use in numerous restaurants and public restroom facilities. This dryer outputs a heated airflow for drying hands or a head, but does not have a vent construction designed to uniformly output warm air over a person's entire body.

U.S. Pat. No. 3,007,256 teaches a low temperature, hot air stove which outputs heated air upwardly through a plurality of evenly-spaced perforations in a cover plate. This dryer has the shape of a relatively shallow pan and items to be dried or heated are placed directly on the plate, over the perforations, or are suspended immediately thereover. This dryer similarly does not teach the unique vent construction of the present invention disclosed herein, which, as will be described below, is designed to uniformly output air along the length of a long, vertical vent.

SUMMARY OF THE INVENTION

A device constructed in accordance with the invention has a blower that generates a forced airflow. The airflow is forced or blown into a downwardly extending generally vertical conduit. This conduit is positioned directly below the blower and has an upper end, with an opening for receiving the airflow, and a closed lower end. The conduit further has a pair of symmetrically converging lateral sidewalls, a forward sidewall and a rearward sidewall. The forward and rearward sidewalls also converge with respect to each other and the rearward sidewall is mountable to a wall structure.

The conduit's sidewalls define an elongated converging airflow channel through which the airflow travels in the direction of the channel's convergence. An elongated vent is positioned in and through the forward sidewall and extends vertically substantially along the entire length of the forward sidewall and, hence, along the length of the channel. Since the channel is convergent, its cross-sectional area decreases gradually along its length and the length of the vent. This causes air to flow forwardly and outwardly through the vent in a substantially continuous and uniform manner along the vent's entire length.

The air is heated prior to entry into the channel by conventional electric heating elements operatively positioned between the blower and channel. Air issuing from the blower passes over the heating elements and is heated thereby before entry into the channel. Preferably, the vent and conduit are sufficiently long enough so that a person standing near the vent will have his or her entire body warmed and/or dried by heated air issuing from the vent.

BRIEF DESCRIPTION OF THE DRAWINGS

In the drawings, like reference numerals and letters refer to like parts throughout the various views, and wherein:

FIG. 1 is a side elevational view of a drying or warming device constructed in accordance with a preferred embodiment of the invention, and shows the device mounted to a wall and operative to dry the body of a user;

FIG. 2 is a pictorial view of the device shown in FIG. 1;

FIG. 6 is a rearward view of the device shown in FIGS. 1 and 2; and

FIG. 7 is a cross-sectional view of the device shown in FIG. 2, and is taken along line 7—7 in FIG. 2.

BEST MODE FOR CARRYING OUT THE INVENTION

Figure 3:
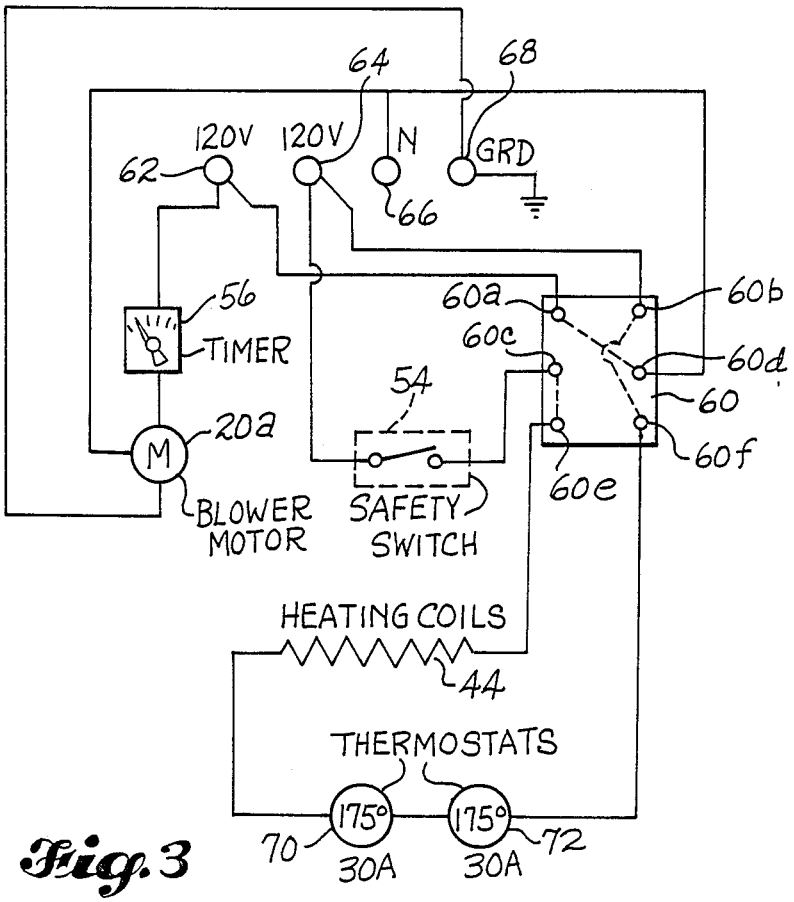
FIG. 3 is an electrical schematic showing the electrical circuitry for the device shown in FIGS. 1 and 2.

Referring now to the drawings, and first to FIGS. 1 and 2, therein is shown at 10 a drying device constructed in accordance with a preferred embodiment of the invention. The device is shown mounted by any suitable means to a wall structure 12, in a position that is conveniently located for a person 14 exiting from a shower or bath to stand in front of the same.

Figure 5:
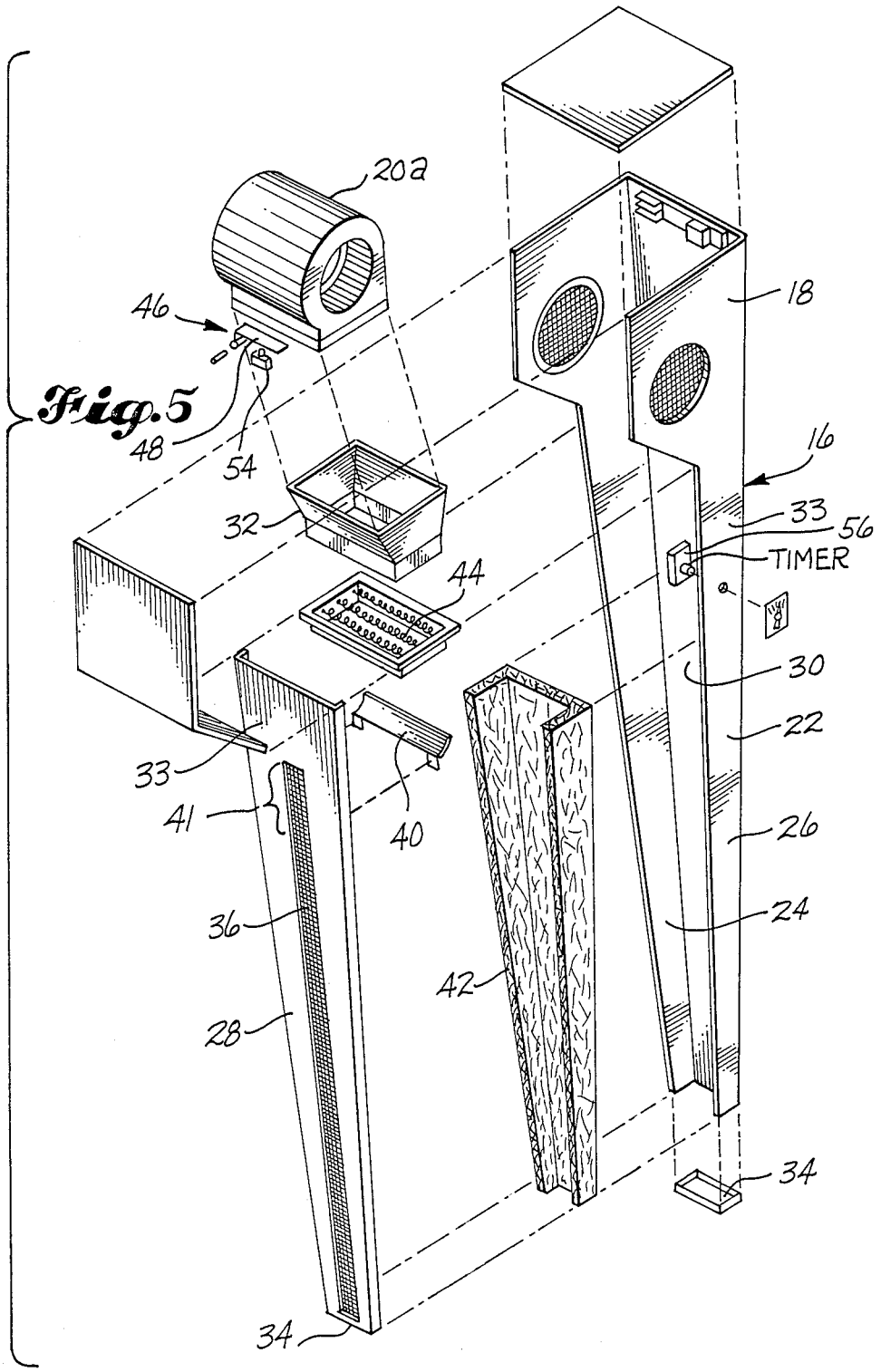
FIG. 5 is an exploded pictorial view of the device shown in FIG. 2.

The device 10 includes a housing 16, an upper blower portion 18 of which encloses a motor-driven blower (see FIG. 5). A lower vent or conduit portion 22, hereafter "conduit", connected to the blower portion 18 of the housing 16, extends vertically downwardly below the blower portion. The conduit 22 has a pair of symmetrically convergent lateral sidewalls 24, 26, a forward sidewall 28 and a rearward sidewall 30. The forward and rearward sidewalls 28, 30 also converge with respect to each other, as shown in FIG. 1. The conduit's sidewalls 24, 26, 28, 30 therefore define a downwardly extending convergent channel 31. The inside of the channel 31 is covered by a layer of insulation 42 on the lateral and rearward sidewalls 24, 26, 30.

The rearward sidewall 30 is attached to the wall 12 by any suitable means. For example, a horizontal slot may extend through the rearward sidewall, such slot would permit the device 10 to be hung from a flange mounted to the wall, in much the same way as many conventional bathroom sink fixtures are mounted to a wall. Since this is not an important feature of the invention it has not been shown in the drawings.

The upper end of the conduit 22 is open and received therein is a blower port 32. The blower 20, which is conventional and would be familiar to a person skilled in the art, generates a forced airflow that is directed into the port 32 which further directs it downwardly through the upper end of the conduit 22. The lower end 34 of the conduit 22 is closed, and a narrow, elongated side vent 36 is positioned in and through the conduit's forward sidewall 28. As the airflow moves downwardly through the channel 31, in the direction of its convergence, the air uniformly exits through the vent 36 in the manner shown by arrows 38 in FIG. 1. The cross-sectional area of the channel 31 decreases gradually along the length of the vent 36, from the conduit's upper end 33 to its lower end 34. This causes the airflow to be output relatively uniformly along the vent's length.

Preferably, the vent 36 extends along substantially the entire length of the forward sidewall 28 as shown in FIGS. 1, 2 and 5. The vent 36 should be long enough so that it approximately corresponds to the height of the user 14. In preferred form, a curved air deflector 40 is mounted to the inside of the forward sidewall 28, near the upper portion 41 of the vent 36. This deflector ensures a sufficient amount of airflow is output from the vent's upper portion.

Figure 4:
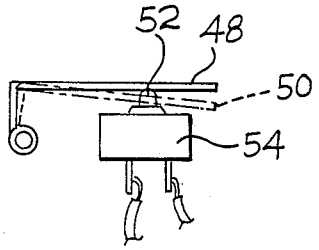
FIG. 4 is an isolated side elevational view of a safety switch device which is used in the device shown in FIGS. 1 and 2.

A conventional electric resistance heating element 44 is positioned just below the blower port 32, and heats the airflow prior to its entry and travel downwardly through the channel 31. A safety control device, indicated generally at 46, is provided for ensuring the heating elements 44 will not be turned on when the blower motor 20 is nonoperational. This device includes a deflectable vane member 48 (see FIG. 4) positioned inside port 32 so that air pressure from the blower 20 causes the vane 48 to deflect downwardly (as shown at 50). This, of course, only happens when the blower 20 is operational. This, in turn, activates a button 52 on a conventional safety switch 54, which permits electrical energy to be supplied to the heating elements 44.

The device 10 is made operational by activating a conventional timer switch 56 mounted to one of the lateral sidewalls 30. This switch 56 causes the motor 20A of blower 20 and the heating elements 44 to be activated. Referring to FIG. 3, therein is shown an electrical schematic which explains the control circuitry of the various above-described components. This circuitry is conventional in nature and would be well-understood by a person skilled in the art.

The blower motor 20A and the heating elements 44 are energized by conventional 120 volt terminals 62, 64. The motor 20A has the terminals connected to terminal 62 through timer 56, to the neutral terminal 66 and to the ground terminal 68. Power to the blower motor 20A is controlled by timer 56. The safety switch 54 controls power to the heating elements 44 from terminal 64. As described above, vane member 48 activates switch 54 only when blower motor 20A is operating which is, of course, an important safety feature. Also, if desired, additional thermostats 70, 72 may be suitably mounted adjacent heating elements 44 and would break the electrical circuit between the elements and power source if the thermostats 70, 72 sensed a temperature above a certain selected temperature. The selected temperature may be, for example, 170° F. as shown in FIG. 3. The electrical circuits which operate both the blower motor 20A and heating elements 44 are routed through a terminal box 60. The connections between the various terminals 60*a*, 60*b*, 60*c*, 60*d*, 60*e*, 60*f* are shown by dashed lines.

It should be appreciated that the preferred embodiment described above could be altered and/or modified without departing from the spirit and scope of the invention. It is to be appreciated that at least one unique aspect of the invention is that its novel sidewall construction causes uniform airflow to be output through the vent 36. This principle could be applied to blow-dry a person's body, or the device 10 could be miniaturized, if desired, for use in drying smaller body portions or even hands. Therefore, the above description is not to be taken in a limiting sense and the spirit and scope of the invention is to be limited only by the subjoined patent claims which follow.

What is claimed is:

1. A device mounted to a wall surface for drying a standing person, comprising:

a housing having an elongated vertical vent portion and a blower portion connected to and positioned immediately above said vent portion, said both portions being at least partially defined by a single rearward wall and a pair of laterally converging side walls, said rearward and said side walls all being flat and extending continuously from the top of said blower portion to the bottom of said vent portion, said rearward wall being adapted to be mounted to a wall surface and defining the backs of said both portions and having lateral side edges which continuously converge symmetrically with respect to each other, said side walls projecting forwardly of said rearward wall with the lateral edges of said rearward wall defining the angle of convergence of said side walls, and with said vent portion being further defined by a forward side wall that extends from immediately below said blower portion to the bottom of said vent portion, said forward side wall in cooperation with said rearward wall and said lateral side walls defining a downwardly converging airflow conduit having a closed bottom and a rectangular cross-section which decreases continuously along the downward length of said vent portion, and a narrow elongated rectangular vent positioned in and through said forward side wall and extending substantially the length thereof;

an electric motor driven blower received in said blower portion and operable to generate a downwardly directed airflow into said vent portion, said lateral side walls each having an air inlet vent positioned adjacent said blower;

a port member positioned inside said housing substantially at the interface of said blower and vent portions, said member supporting said blower and having an upwardly directed opening in airflow communication with said blower for receiving said downwardly directed airflow, said port member further having a downwardly directed opening communicating in the upper end of said vent portion conduit for directing said airflow into said conduit; and an electric heating element, positioned immediately below the downwardly directed opening of said port member, and operable to heat said airflow.

2. The device of claim 1, including a layer of insulation positioned adjacent an inner surface of, respectively, said rearward wall and said lateral side walls.

3. The device of claim 1, including a single air deflector positioned horizontally across the upper end of said rectangular vent opening, said deflector extending rearwardly into said conduit and being shaped and positioned in a manner so as to deflect a portion of said airflow outwardly through the upper end of said vent opening.

4. The device of claim 1, including a rectangular vane member positioned in said port member in a manner so that said vane member bends in response to said generated airflow, and a safety switch member positioned adjacent said vane member, said switch member being connected in circuit with said heating element and responsive to bending movement of said vane member, for operating said electric heating element in response to such movement.

* * * * *